US005295345A

United States Patent [19]

Ter Haar

[11] Patent Number: 5,295,345

[45] Date of Patent: Mar. 22, 1994

[54] BAG SEALER

[75] Inventor: Herman W. J. Ter Haar, Bodegraven, Netherlands

[73] Assignee: Henkel Nederland B.V., Netherlands

[21] Appl. No.: 794,470

[22] Filed: Nov. 19, 1991

[51] Int. Cl.[5] ..... B65B 51/06

[52] U.S. Cl. ..... 53/583; 53/136.5; 53/139.1

[58] Field of Search ..... 53/136.5, 139.1, 583; 156/483, 522

[56] References Cited

U.S. PATENT DOCUMENTS

| | | | |
|---|---|---|---|
| 2,882,663 | 4/1959 | Leighton | 53/583 |
| 4,537,005 | 8/1985 | Hoyland | 53/583 X |
| 4,718,220 | 1/1988 | Van Rosendal et al. | 53/583 |

FOREIGN PATENT DOCUMENTS

| | | | |
|---|---|---|---|
| 7810993 | 5/1980 | Netherlands . | |
| 8501266 | 3/1985 | PCT Int'l Appl. . | |
| 8808395 | 11/1988 | PCT Int'l Appl. . | |
| 9102682 | 3/1991 | PCT Int'l Appl. | 53/139.1 |
| 1334146 | 10/1973 | United Kingdom | 53/583 |

*Primary Examiner*—John Sipos

*Assistant Examiner*—Daniel Moon

*Attorney, Agent, or Firm*—Willian Brinks Hofer Gilson & Lione

[57] ABSTRACT

An apparatus for binding an article with adhesive tape is disclosed which includes a housing having a cavity bounded by a front wall and a rear wall for accommodating a supply of adhesive tape. A rotatable star wheel having a number of radial recesses at equal angular distances for receiving an article to be bound with tape, and a peripheral surface. Two mutually registered open channels in the front and rear walls of the housing are formed, such that an article for binding may be transported from the top to the bottom of the housing. A tilt member located adjacent the star wheel having an actuating part pivotal about an axis towards and away from the star wheel and resiliently urged by a spring. A cutter affixed to the tilt member adjacent the star wheel and actuable by a through-fed article for cutting the tape. A stopper cam on the tilt member for limiting the displacement of the tilt member such that the cutter does not engage the peripheral surface of the star wheel while cutting the tape. The stopper cam on the tilt member contacts another stopper cam on the star wheel.

10 Claims, 6 Drawing Sheets

BAG SEALER

BACKGROUND OF THE INVENTION

The invention relates to a device for binding an article with adhesive tape, whereof ends can adhere to one another, which device comprises:

a housing with a cavity bounded by a front wall and a rear wall for accommodating a supply roll of the adhesive tape with:

means for guiding the tape;

means for carrying an article at least along and against the adhesive side of the first tape; and cutting means actuable by a through-fed article for cutting off the tape after the article has passed through the said means, a star wheel rotatable with light friction having a number of substantially radial recesses disposed at mutually equal angular distances, two mutually registered channels open to the top present in the front wall and the rear wall respectively of the housing and wherethrough an article for binding has to be moved from top to bottom, wherein the adhesive tape is guided over the top part of the star wheel with the sticking side facing outward, wherein the star wheel is formed and positioned relative to the channels such that an article for binding engages onto the star wheel in a recess thereof carrying with it the first tape adhering thereto, the opening of which recess is situated in the region of the channels, whereby the star wheel is set into rotation so that in the recess the article is bound with the first tape with the progressive rotation of the star wheel, and wherein the cutting means comprise a tilt piece with an actuating part movable pivotally about a pivot axis towards and away from the star wheel, which tilt piece is constrained by spring means to a rest position wherein the cutting knife is located at an interval from the star wheel and the actuating part is located in the region of the channels for actuating of the tilt piece by an article carried through the channels and cutting through the tape wherewith an article is bound, which cutting knife in the extreme active cutting position remote from the rest position lies with its active front part in a recess of the star wheel.

Such a bag sealer is known in diverse embodiments. In a known bag sealer of this type it can occur despite an extremely careful design that due to incorrect use an article for binding becomes jammed in the device or the cutting knife comes with its active front part into contact with the peripheral face of the star wheel. This can occur as a result of improper, for instance rough, use or when an excessively thick article for binding is fed through.

SUMMARY OF THE INVENTION

With a view to the above the invention now provides a device of the stated type characterized by stop means which limit displacement of the tilt piece to the extreme active cutting position to an angular position in which the cutting knife is out of engagement with the peripheral surface of the star wheel in that situation where during that displacement the peripheral surface of the star wheel is situated in the path of the active leading part of the cutting knife.

In particular the device can be embodied such that the tilt piece carries a first stopper cam and the star wheel carries second stopper cams corresponding with the number of recesses and disposed at mutually equal angular distances.

In a particular embodiment the device has the feature that the second stopper cams are situated between the recesses. Very effective use is made in this way of the available space.

This latter embodiment can advantageously have the feature that the first stopper cam extends adjacent to and beyond the active leading part of the cutting knife.

In a particular embodiment the first stopper cam and/or each second stopper cam has a rounded active cam surface. This reduces the risk of the mutually coacting cam surfaces engaging onto one another such that rotation of the star wheel is impeded.

Possible in this respect is a still better solution wherein the first stopper cam and/or each second stopper cam has a tapering active cam surface.

BRIEF DESCRIPTION OF THE DRAWINGS

The invention will now be elucidated with reference to the annexed drawing, wherein.

DETAILED DESCRIPTION

Figure 1:
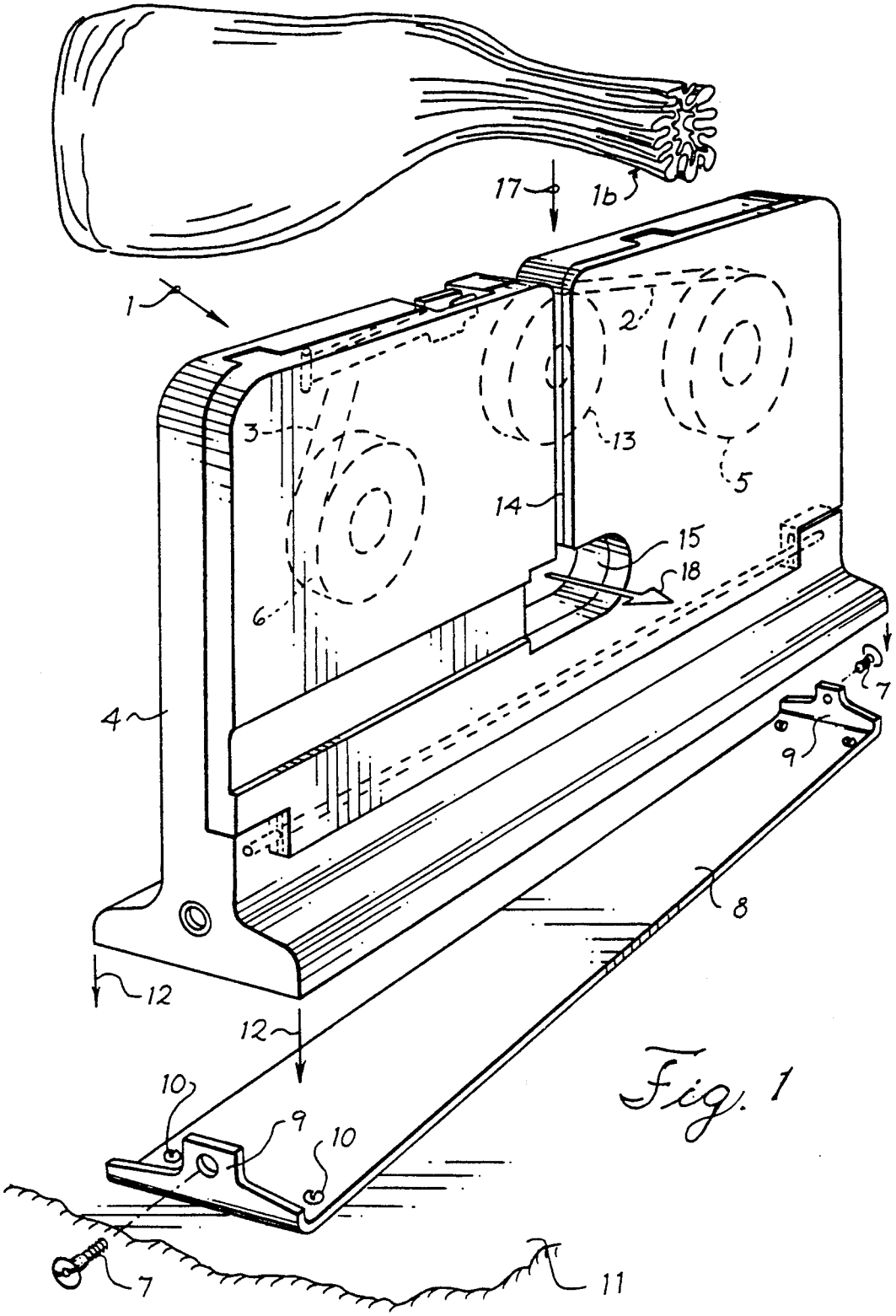
FIG. 1 shows a perspective view of a bag sealer whereof the base plate is drawn remotely.

FIG. 1 shows a device 1 according to the mentioned nonprepublished Netherlands patent application 8902097 of applicant for arranging round an article 16 (see FIG. 3), in particular a bundle of plastic foil such as a plastic bag, a bunch of flowers or the like, a binding consisting of single-sided adhesive tape 2 whereof end zones can adhere to one another in a manner to be described further, in addition to a paper tape 3 for arranging against the free adhering ends thereof such that the ends of the adhesive tape 2 can be grasped individually and separated by tearing through the paper tape 3.

The device 1 comprises a housing 4 with an internal cavity for accommodating a supply roll 5 of the adhesive tape 2 and a supply roll 6 of paper tape 3. The housing can be fixed by means of screws 7 on a base plate 8 which has for this purpose bent, upright ends 9. The base plate 8 is fixed to a work surface 11 by means of screws 10.

As indicated by arrows 12 the underside of the housing can substantially entirely cover the base plate 8.

Via a star wheel 13, to be further described hereinafter and designated schematically here, over which the adhesive tape 2 is guided, an article 16 for binding, in particular a bundle of plastic foil, is inserted by the user with force from above according to an arrow 17 at the open top part of a straight channel 14, fed therethrough with force until the article has reached the underside of the channel 14 provided with a widening 15 and in bound state can subsequently be removed therefrom in sideways direction according to arrow 18.

Figure 1A:
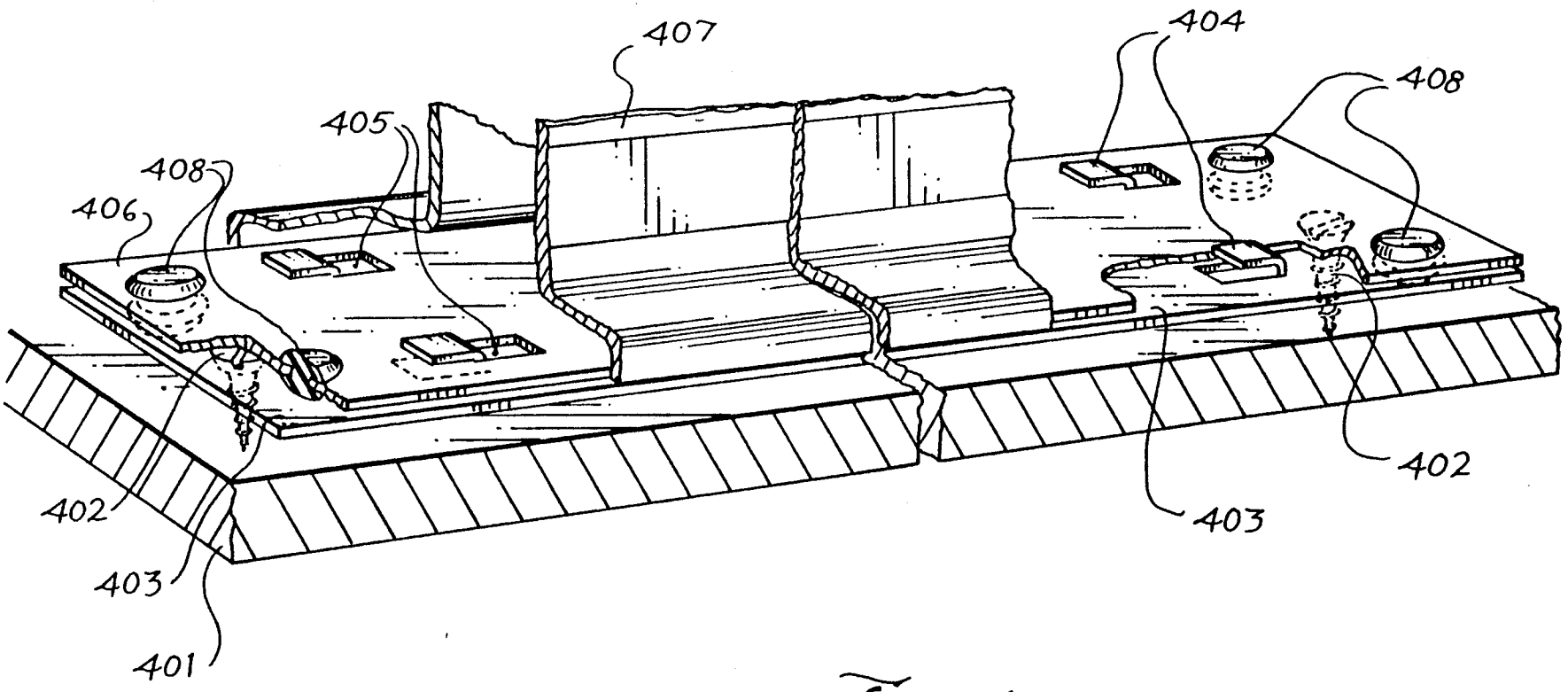
FIG. 1*a* is a partly broken away perspective view of a detail wherein can be seen another manner of fixing the device to a work surface or on a wall.

FIG. 1*a* shows a work surface 401 whereon a steel fixing plate 403 is fastened by means of screws 402. This fixing plate 403 has four hooks 404 pressed out of the surface of the plate which can co-act with holes 405 in a base plate 406 of the bag sealer 407. The base plate 406 likewise has a number of holes through which are arranged rubber tulles 408. The dimensioning is such that the bag sealer 407 can only be pushed with the base plate 406 with friction force under the hooks 404 by depressing the rubber tulles 408. This ensures a very robust clamp fixing of the bag sealer 407 on the work surface 401. It will otherwise be apparent that this manner of fixing can also be applied for wall attachment.

Figure 2:
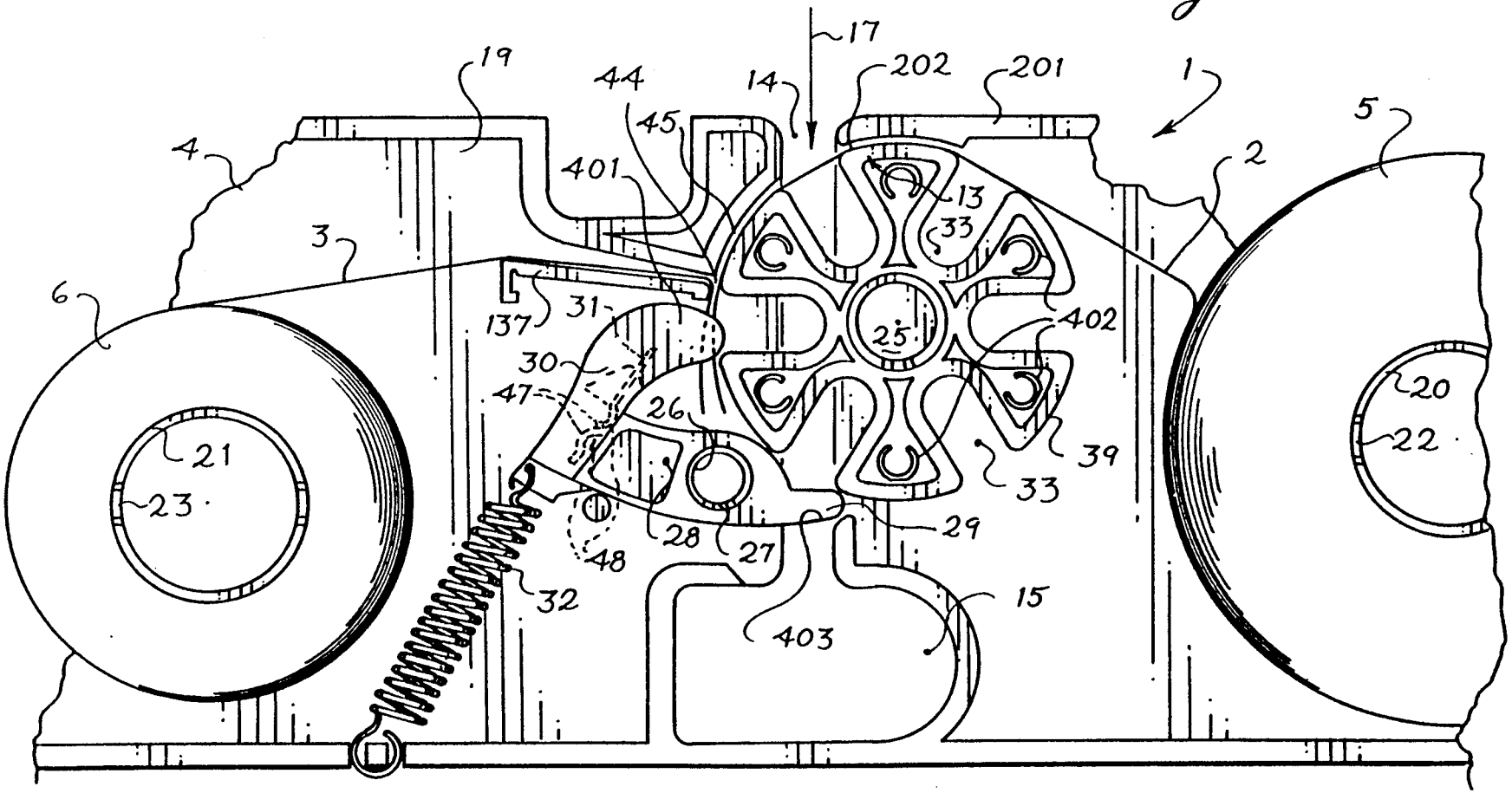
FIG. 2 shows a side view of the most important part of the interior of the bag sealer.

FIG. 2 shows the interior of the device 1, or at least the essential components and their interrelation, wherefor reference is also made to the FIGS. 4, 5, 6, 7 and 8.

The device comprises a housing whereof the rear wall 19 is drawn, which rear wall comprises the straight channel 14 which has the widening 15 at the bottom. The supply rolls 5 and 6 are carried by the respective carrier cylinders 20, 21 moulded on the rear wall 19 by injection moulding and whereof a wall portion 22, 23 is embodied as an outwardly resilient lip such that the inside of the supply rolls 5, 6 is rotatable with light friction over the carrier cylinders 20, 22 and 21, 23. The lip-shaped wall portions 22, 23 extend in lengthwise direction of the cylinders 20, 21 and each have on their outer surface a cam which ensures a small axial locking of the supply rolls 5, 6.

The star wheel 13 also accommodated in the housing 4 is carried rotatably by a like carrier cylinder 24 with resilient lip 25, whereby the star wheel 13 is rotatable in housing 4 with small friction.

The cavity inside housing 4 displays a narrow outlet opening 202 bounded on one side by the upper wall 201 and on the other by the star wheel 13 and through which the adhesive tape 2 is fed over the star wheel 13 to a nip to be described hereinbelow where the adhesive tape 2 is placed into co-action with the paper tape 3. The height of the passage opening amounts in this embodiment to roughly 2 mm, while the breadth of the opening is only a little greater than the breadth of the adhesive tape. In this respect reference is also made to FIG. 4.

A carrier cylinder 26 with resilient lip 27 bears a tilt piece 28 whereof an outer end 29 acting as actuating part is located in the region of the channel 14 in the drawn rest position, while extending from the end remote therefrom is a tapering projection 30 serving as knife holder, in which holder 30 is received a cutting knife 31. The tilt piece 28 is loaded by a draw spring 32.

The longitudinal direction of the active leading part of the cutting knife 31 is more or less tangentially oriented relative to the pivot axis defined by the carrier cylinder 26. In the drawn rest position the draw spring extends roughly tangentially relative to the said pivot axis.

The star wheel 13 has six recesses 33 placed equidistantly in angular direction.

The actuating part 29 is loaded by the draw spring 32 such that it exerts a spring pressure on the star wheel 13. As FIG. 2 clearly shows, in the shown angular position a recess is located with its free opening in the region of the channel 14 so that an article can be placed therein to be bound by the device 1.

As shown in FIG. 2 the paper tape 3 is guided over the top surface of a guiding 137 while the single-sided adhesive tape 2 is guided with its adhesive side facing upward over the top of star wheel 13. In the above described nip designated with the reference numeral 44 the tapes 2 and 3 come together and are brought together between the guiding 137 and star wheel 13.

Situated above the nip 44 is a guide face 45 having the same shape as the peripheral wall 39 of the star wheel 13.

The tilt piece 28 carries a first stopper cam 401 which is situated adjacent the knife holder 30 and extends beyond the active leading surface of the cutting knife 31. The stopper cam 401 has the rounded forward part shown in FIG. 2 and serves for co-action with second stopper cams 402 which are arranged on the star wheel and are situated in this embodiment between the recesses 33.

The tilt piece 28 has on its active extremity 29 a flat contact face 403 which lies roughly perpendicularly of the longitudinal direction of the channels 14. This furthers a positive engagement between an article for binding and the tilt piece.

Figure 3:
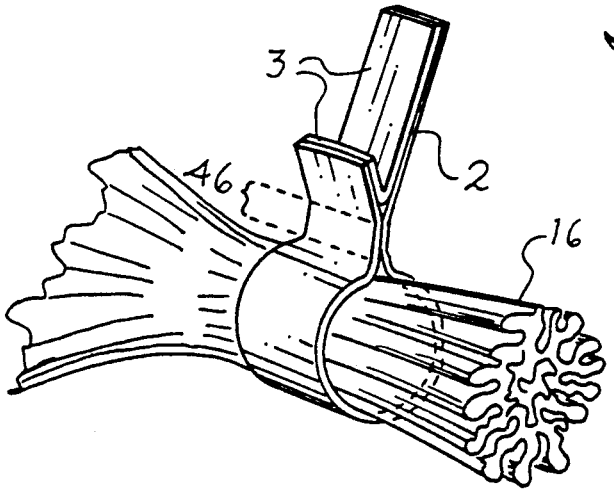
FIG. 3 shows a bundle of foil which is bound by the bag sealer.

As previously mentioned, FIG. 3 shows a bundle of plastic foil, for instance the end of a packing bag for binding and thereby sealing. The bundle 16 is bound by adhesive tape 2 the free ends of which are mutually adhered along zones 46, while the adhesive sides extending outward beyond this zone 46 are jointly covered by a strip of paper tape 3.

Figure 4:
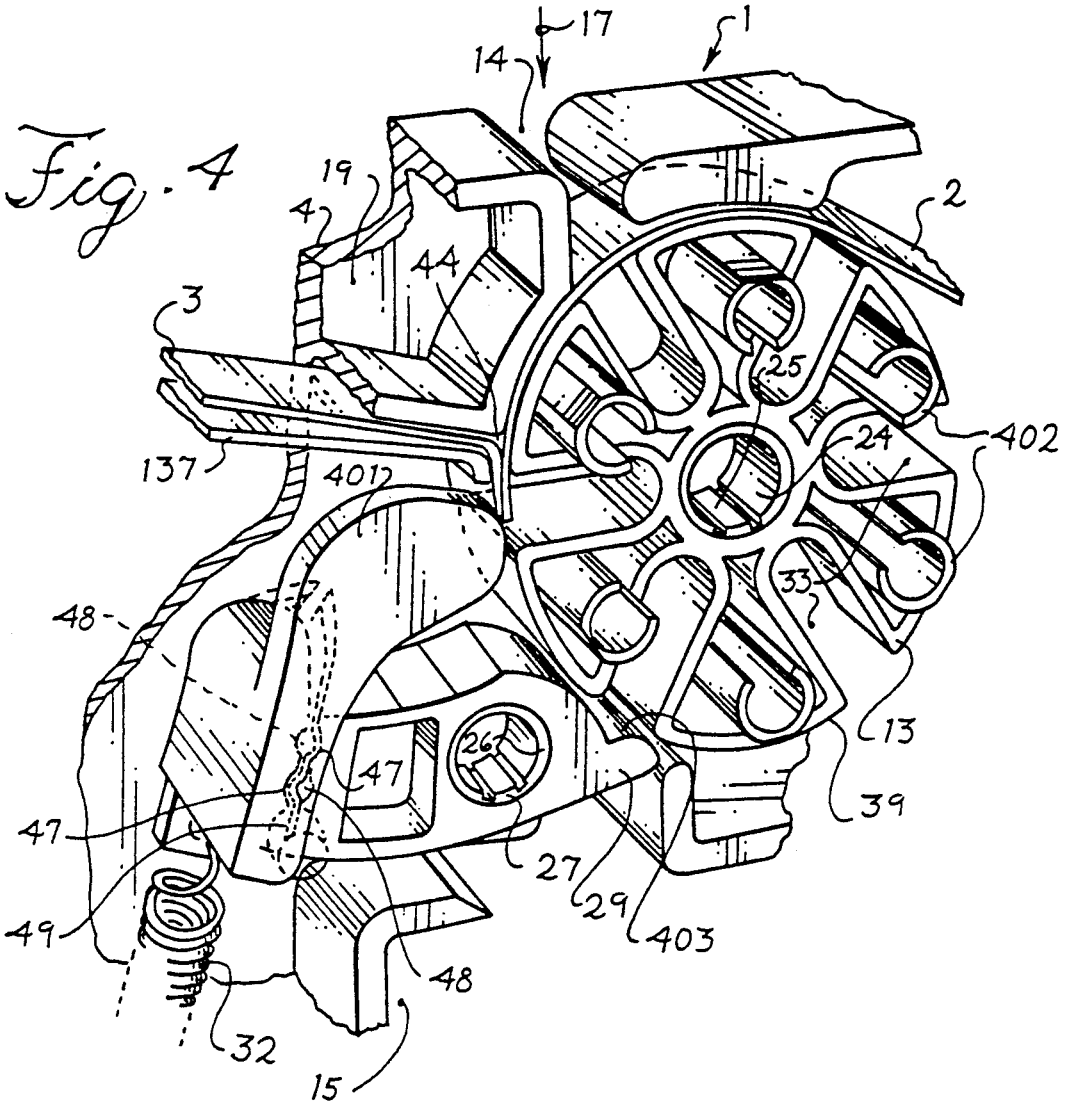
FIG. 4 shows a partly perspective view of the bag sealer.

FIG. 4 shows in perspective view a portion of the device according to FIG. 1. As can be seen, the knife holder 30 is shaped tapering on four sides. The cutting knife 31 has two points with two pairs of cutting edges.

As is apparent from FIG. 4, the cutting knife 31 is fixed by two ribs 47 arranged therein which are received in hollows 48 present in the tilt piece 28 and which adjoin a slot 49 for receiving the cutting knife 31.

It can further be seen clearly from FIG. 4 that the second stopper cams 402 protrude axially outside the star wheel 13 so that the first stopper cam 401 can pass over the axial end face of this star wheel in order to co-act with the protruding stopper cams 402.

The FIGS. 5–8 show successive phases of the binding of an article with the device 1 according to the invention.

Figure 5:
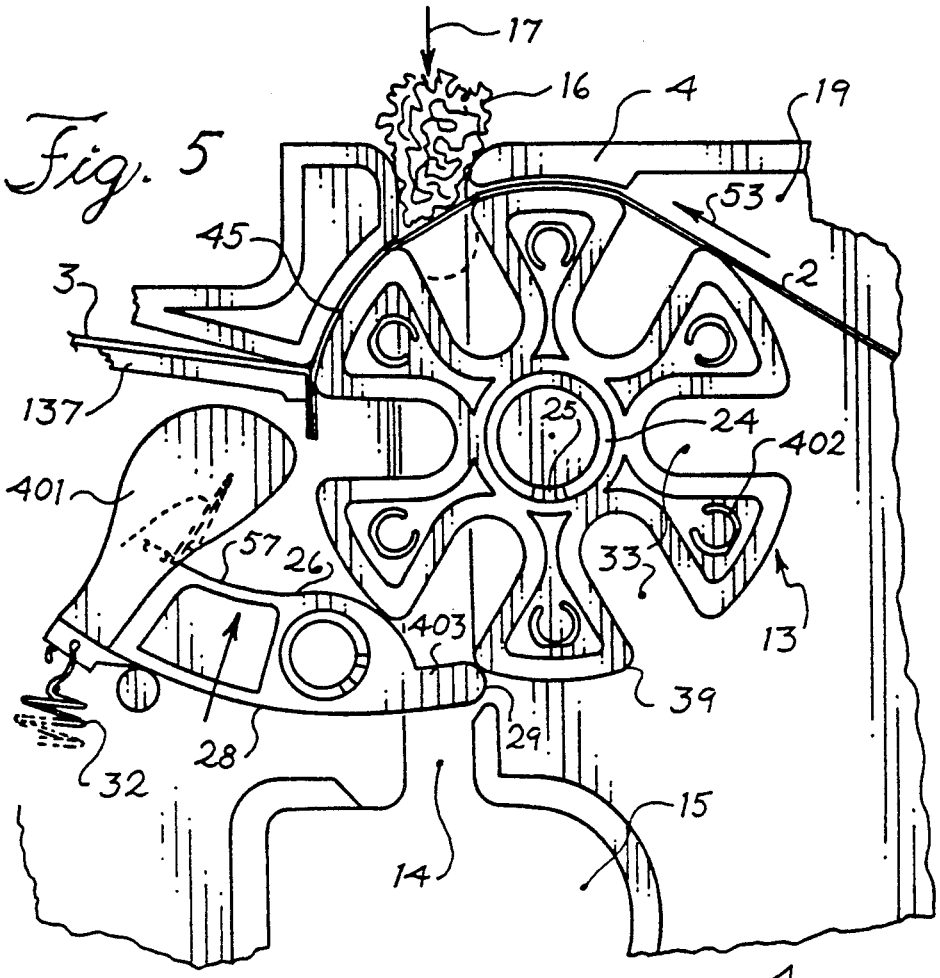
FIGS. 5, 6, 7, 8 show four phases of the binding cycle.

As shown in FIG. 5, the article 16 is introduced according to arrow 17 into the straight channel 14. It is taken up into the recess 33 of star wheel 13 present in that region carrying with it a piece of adhesive tape 2 according to arrow 53.

Figure 6:
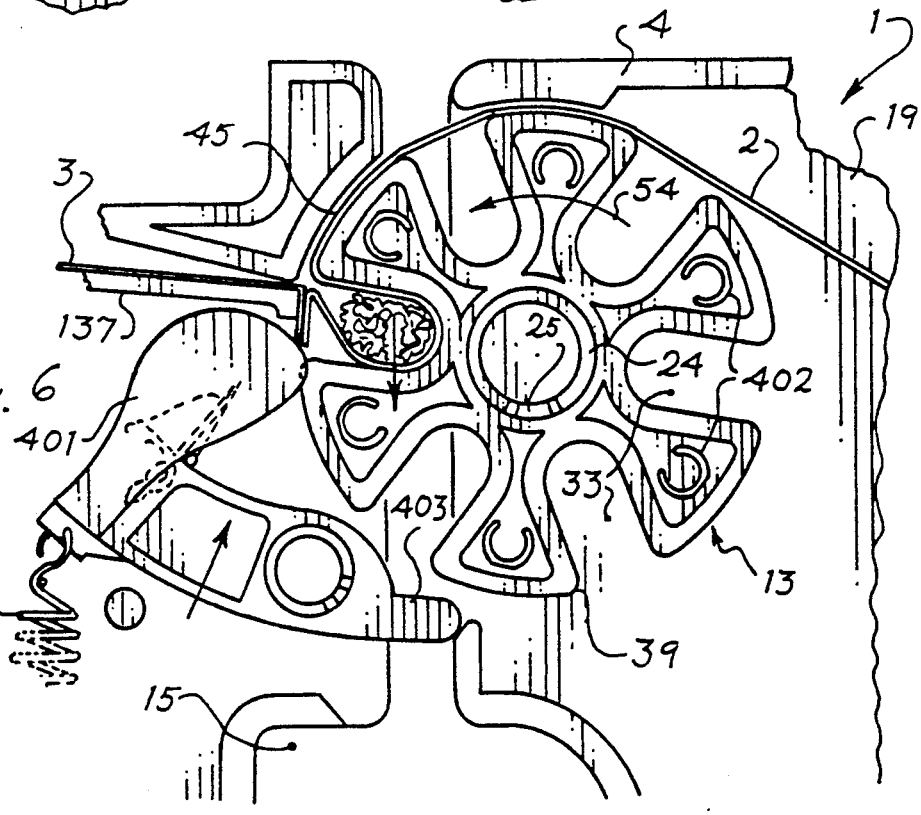

FIG. 6 shows that according to arrow 54 the star wheel is set into rotation by the article 16 being displaced downward with some force by the user. Thereby formed round the article 16 is a loop of adhesive tape 2 whereof the free ends are carried towards one another with their adhering sides.

Figure 7:
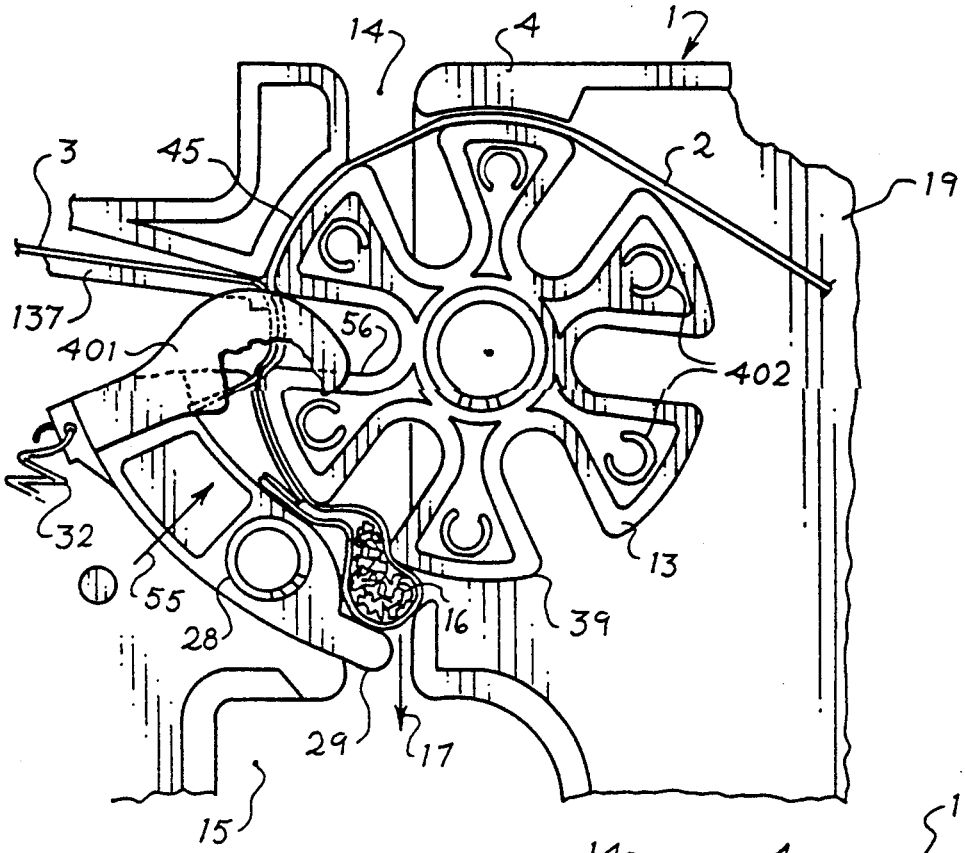

In the phase according to FIG. 7 the rotation of the star wheel 13 has progressed still further and a strip of paper tape 3 has also been carried along. The article 16 thereby comes into force transmitting engagement with the actuating part 29 of tilt piece 28 and sets the latter into pivoting movement according to an arrow 55, whereby the cutting knife 31 displaces in the direction of the recess 33 of the star wheel 13 then present there, in front of which a combination of mutually adhered paper tape 3 and adhesive tape 2 under tensile stress is then situated, which can subsequently be cut through by the cutting knife 31.

As shown clearly in FIG. 7, the cutting knife 31 is located at a small distance from the bottom surface 56 of the relevant recess 33 whereby the tape laminate has only a small deflection possibility, which aids sharp cutting.

After removing the article from the device in the situation shown in FIG. 8 the device is once again ready for re-use and after rotation through 120° the star wheel 13 is again situated in the same active position as at the beginning of the cycle as shown in FIG. 5.

FIG. 5-8 also show the functional co-action between the stopper cam 401, which is arranged on the tilt piece 28, and the second stopper cams 402 on the star wheel 13.

In the situation of FIG. 6 the stopper cam 401 is out of engagement with the stopper cams 402. In the subsequent phase of a binding operation according to FIG. 7, the actuating part 29 is in force transmitting contact with the article 16, whereby the tilt piece 28 tilts in the direction according to arrow 55. The first stopper cam 401 displaces towards the middle of the star wheel 13, wherein the active leading surface of the cam 401 will come into light engagement with one of the relevant cams 402. This ensures a positive positioning of the star wheel 13 such that the cutting knife 31 has exactly the correct position relative to the relevant recess 33.

Figure 8:
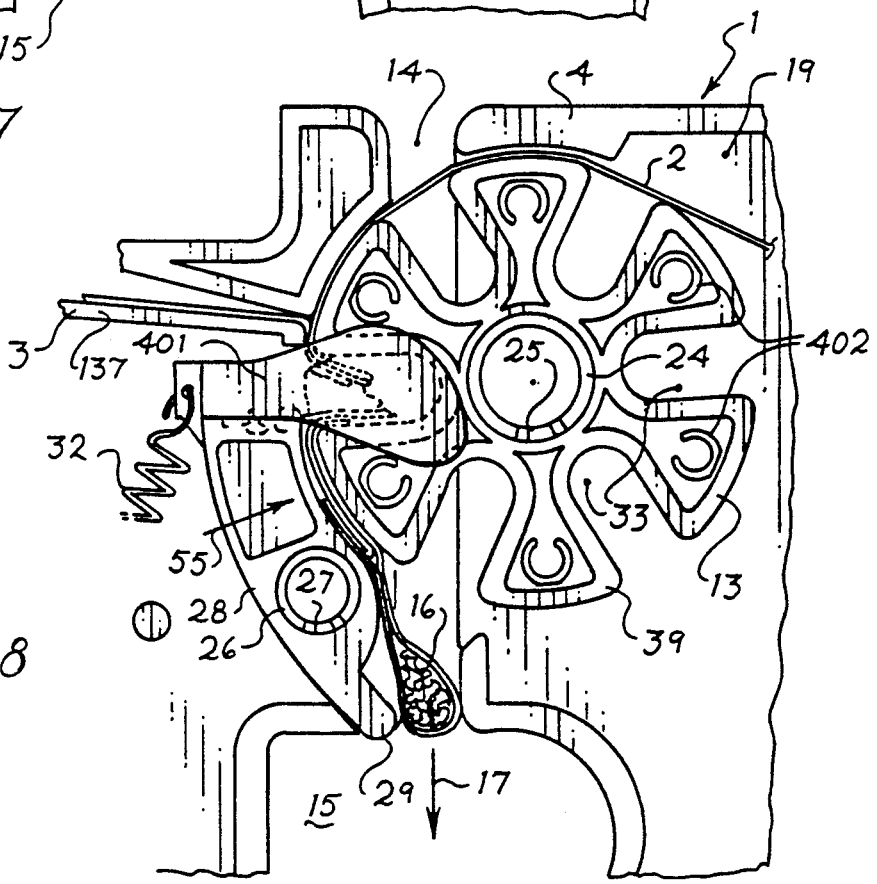

FIG. 8 shows the moment of severing with corresponding co-action between the first cam 401 and the second cams 402.

It will also be apparent from the foregoing that when the binding operation has ended the star wheel 13 is correctly positioned in all circumstances for insertion of a following article for binding.

I claim:

1. An apparatus for binding an article with adhesive tape comprising:

a housing having a cavity bounded by a front wall and a rear wall for accommodating a supply of adhesive material;

means for guiding said adhesive material;

mans for transporting an article at least along and against said adhesive material;

rotatable star wheel, said star wheel having a number of substantially radial recesses disposed at mutually equal angular distances, and a peripheral surface, said star wheel mounted to said housing between two mutually registered open channels in the front wall and rear wall of said housing, such that an article for binding may be transported from the top to the bottom of the housing through said channels;

a tilt member, said tilt member located adjacent said star wheel and extending between said channels, said tilt member having an actuating part movably pivotal about a pivot axis towards and away from said star wheel, said tilt member having a spring means for releasably urging said tilt member to a rest position from which the tilt member may be pivoted to an active position;

cutting means actuable by a through-fed article engaging said actuating part for cutting said adhesive material as said article is passed through said channels, said cutting means affixed to said tilt member and adjacent to said star wheel such that said cutting means is in an extreme cutting position for cutting said adhesive material when said tilt member is pivoted to an active position by a through-fed article engaging said actuating part;

stop means configured to limit the displacement of said tilt member such that said cutting means is out of engagement with said peripheral surface of said star wheel when said tilt member is pivoted to an active position, said stop means comprising a first stopper cam affixed to said tilt member and at least one second stopper cam affixed to said star wheel, such that the first and second stopper cams contact as said tilt member is pivoted to an active position to limit the displacement of the tilt member and cutting means;

wherein said adhesive material is guided over the star wheel and said star wheel is positioned such that an article for binding engages in a recess opening of said star wheel, the opening of the recess being situated between the channels such that as the star wheel is rotated, the article is bound with the adhesive material and the actuating part of said tilt member releases the tilt member from a rest position to an active position such that the cutting means engages the adhesive material and said stop means limits the displacements of the cutting means such that the cutting means is out of engagement with said peripheral surface of said star wheel as said adhesive material binds the article.

2. The apparatus of claim 1 wherein said first stopper cam extends adjacent to and beyond the cutting means.

3. The apparatus of claim 1 wherein the first stopper cam has a rounded active cam surface.

4. The apparatus of claim 1 wherein the second stopper cam has a rounded active cam surface.

5. The apparatus of claim 1 wherein the first stopper cam has a tapered active cam surface.

6. The apparatus of claim 1 wherein the second stopper cam has a tapered cam surface.

7. The apparatus of claim 1 further comprising a plurality of second stopper cams corresponding to the number of recesses of the star wheel and disposed at mutually angular distances on the star wheel.

8. The apparatus of claim 7 wherein said plurality of second stopper cams are situated between said recesses.

9. The apparatus of claim 7 wherein the plurality of second stopper cams have rounded active cam surfaces.

10. The apparatus of claim 7 wherein the plurality of second stopper cams have tapered cam surfaces.

* * * * *

UNITED STATES PATENT AND TRADEMARK OFFICE

CERTIFICATE OF CORRECTION

PATENT NO. : 5,295,345
DATED : March 22, 1994
INVENTOR(S) : Herman W.J. Ter Haar It is certified that error appears in the above-indentified patent and that said Letters Patent is hereby corrected as shown below:

Col. 5:

In Claim 1, line 7, delete "mans" and substitute --means--.

Signed and Sealed this

Twenty-third Day of August, 1994

*Attest:*

Bruce Lehman

BRUCE LEHMAN

*Attesting Officer*

*Commissioner of Patents and Trademarks*